US005194904A

United States Patent [19]

Ruch

[11] Patent Number: 5,194,904

[45] Date of Patent: Mar. 16, 1993

[54] EXITING PAPER DEFLECTOR APPARATUS FOR AN IMAGE REPRODUCTION MACHINE

[75] Inventor: Mark H. Ruch, Spring, Tex.

[73] Assignee: Compaq Computer Corporation, Houston, Tex.

[21] Appl. No.: 870,053

[22] Filed: Apr. 15, 1992

[51] Int. Cl.[5] ..... G03G 21/00

[52] U.S. Cl. ..... 355/321; 162/269; 162/270; 271/209; 355/309; 355/322

[58] Field of Search ..... 355/308, 309, 321, 322, 355/282; 271/161, 188, 209, 220, 213, 215; 162/269-271

[56] References Cited

U.S. PATENT DOCUMENTS

| | | | |
|---|---|---|---|
| 4,523,754 | 6/1985 | Hisajima et al. | 355/309 X |
| 5,033,731 | 7/1991 | Looney | 271/188 X |

FOREIGN PATENT DOCUMENTS

| | | | |
|---|---|---|---|
| 0043446 | 2/1989 | Japan | 271/209 |
| 0069455 | 3/1989 | Japan | 271/209 |
| 0192661 | 8/1989 | Japan | 271/188 |
| 0267252 | 10/1989 | Japan | 271/209 |
| 0204242 | 8/1990 | Japan | 271/188 |

*Primary Examiner*—A. T. Grimley
*Assistant Examiner*—William J. Royer
*Attorney, Agent, or Firm*—Konneker & Bush

[57] ABSTRACT

An image reproduction machine has an outlet opening through which successive image-imprinted paper sheets are forwardly discharged by a spaced series of exit roller sets. The discharged sheets are delivered into an open-topped housing well area having a horizontal bottom surface with a back edge forwardly and downwardly offset from the outlet opening, and a ramped surface extending downwardly and rearwardly from the horizontal surface back edge. A deflector bar adjacent the outlet opening has first downwardly projecting portions that engage each discharging sheet and temporarily corrugate and stiffen it in a manner assuring that its front end portion will forwardly clear the rear horizontal surface edge before bending down to its level. These downwardly projecting portions are interdigitated with the exit roller sets and positioned to perform their temporary corrugation function without crinkling the discharging sheets. The deflector bar is also provided with second downwardly projecting portions that function, as the stack nears its maximum height, to cause each successive discharging sheet to engage the previously discharged sheet in a manner forwardly advancing and staggering the uppermost sheets. This reduces the effective stack height adjacent the outlet opening to thereby permit a greater number of discharged sheets to be stacked in the well before the stack blocks the external sheet discharge path. A notch in the deflector bar serves to receive and protect the pivoted paper output sensor portion of the machine as the stack is removed from the well.

21 Claims, 3 Drawing Sheets

EXITING PAPER DEFLECTOR APPARATUS FOR AN IMAGE REPRODUCTION MACHINE

BACKGROUND OF THE INVENTION

1. Field of the Invention

The present invention relates to image reproduction machines, such as printers and copiers, and more particularly relates to paper feed apparatus for such machines.

2. Description of Related Art

In conventional image reproduction machines such as, for example, laser printers, cut paper sheets to be imprinted with the reproduced image are fed through printing means within a housing portion of the machine, and then discharged from the housing into an external paper receiving well formed in the housing. In a laser printer, these printing means include a rotating photoconductive drum from which toner, in the pattern of the image to be reproduced, is electrically transferred onto the moving sheet. As is moves away from the drum, the sheet is passed through a fuser structure which, by a combination of heat and mechanical pressure, fuses the applied toner to the sheet.

Upon exiting the fuser structure the sheet is guided through a curved path, typically around a guide roller, to a spaced plurality of exit roller sets that frictionally drive the imprinted sheet through and then horizontally discharge it, in a forward direction, from a horizontally elongated housing outlet opening into the paper receiving well. The bottom side of the well typically has a horizontal paper support surface spaced forwardly apart and downwardly offset from the outlet opening. Extending rearwardly from the back edge of this horizontal paper support surface is a rearwardly and downwardly ramped surface forming a rearward extension of the horizontal support surface.

The exit roller sets each comprise a rotationally driven resilient roller that pinches the sheet against an idler roller whose axis is upwardly and rearwardly offset from the axis of the driven roller. In theory, the exit roller structure of the printer is positioned relative to the overall bottom side of the receiving well in a manner such that a leading edge portion of the first discharged sheet clears the depressed rear area of the well before its natural downward bend causes it to contact and slide forwardly along the horizontal support surface as the balance of the sheet is discharged from the housing outlet opening.

When the first sheet is fully discharged, a rear end portion thereof bends downwardly into the depressed rear well area and comes to rest on the ramped bottom side surface thereof. Each subsequently discharged sheet follows this discharge sequence, but contacts the previously discharged sheet instead of contacting the bottom side surface of the well, so that a bent stack of discharged sheets is progressively formed in the well area of the housing.

While this is the intended discharge path of each imprinted sheet, a potential paper curling problem can distort the discharge path of the sheets such that they simply roll up in the depressed rear well area, thereby preventing the intended bent stacking of the discharged sheets. This paper curling problem is particularly pronounced in instances where relatively light weight paper is being used, and where there is a sharp guide path bend at the exit of the fuser structure, and can cause the leading edge of the first exiting sheet to bend downwardly to an extent that it strikes the ramped well surface instead of the horizontal well surface in front of it.

When this occurs, the sheet simply bends into a rolled configuration and undesirably remains in the depressed well area. The leading edges of successively discharged sheets similarly strike the ramped well surface, or previously rolled sheets as the case may be, and quickly build up to block the paper discharge path.

One previously proposed solution to this problem has been to radially enlarge one relatively thin end portion of each of the driven exit rollers so that as each sheet is pinched between and driven forwardly by the exit roller sets these radially enlarged roller end portions form on the underside of the driven sheet relatively small corrugation lines along the entire length of the sheet. This permanent corrugation of the sheet tends to stiffen it sufficiently so that as it is discharged from the printer housing its leading edge clears the ramped well surface and properly lands on the horizontal well surface in front of it, thereby forming the desired bent stack of discharged sheets in the well area instead of forming a disorderly array of rolled sheets in the depressed rear well portion.

While this permanent sheet corrugation method tends to solve the aforementioned paper curling problem, it often creates a new problem—namely, the "crinkling" of the sheets as they are discharged from the printer housing outlet opening. Specifically, by positioning the thin, disc-shaped corrugating structures immediately adjacent the paper "pinch" zones of the exit roller sets, the sheets are subjected to relatively large side-to-side shortening forces at the points at which they traverse the "nip" areas of the exit roller sets. Accordingly, longitudinal portions of the sheets are forcibly caused to slide longitudinally within the nip areas of the roller sets, thereby crinkling the sheets.

Another limitation commonly associated with conventionally configured image reproduction machines, such as the laser printer discussed above, relates to the maximum number of discharged sheets that may be stacked in the aforementioned bent configuration in the housing well area before the stack blocks the external paper discharge path and must be removed from the well. It will be appreciated from the general well geometry described above that the rear edge of the horizontal bottom well surface must be close enough to the housing outlet opening to assure that the leading edges of the discharging sheets forwardly clear such rear edge before they bend down to a level below that of the horizontal well surface. Otherwise, the previously described sheet roll-up problem will occur.

Of course, the closer this rear edge is positioned to the housing outlet opening, the less likely it is that such roll-up will occur. However, as this rear edge is moved closer to the outlet opening a corresponding decrease in the minimum distance between the ramped well surface and the outlet opening also occurs. While the available stack height directly above the horizontal surface of the open-topped well is not theoretically limited, the maximum number of discharged sheets that may be stacked in the well is limited by this distance between the ramped well surface and the outlet opening. Specifically, as the discharged paper stack grows, at some point the bent rear portion of the top sheet interferes with the discharge of the next sheet, and the stack must be removed from the well before subsequent sheets can be discharged thereto.

In printers, and other types of image reproduction machines having this conventional well and paper discharge design, the optimal front-to-rear placement of the rear edge of the horizontal well surface tends to result in an outlet opening-to-ramped well surface dimension which limits the maximum number of discharged sheets that can be received in the well area to a number less than 500 (i.e., the number of cut paper sheets in a standard one ream package). As an example, a conventional printer of the general type described above typically has a discharge stack capacity of from about 425 to about 450 sheets—i.e., a number substantially short of a more desirable 500 sheet stack capacity.

Another problem that conventional printers and other types of image reproduction machines of this well configuration tend to have is related to their pivotally mounted paper output sensor member that is positioned outwardly adjacent the housing outlet opening and functions to monitor the number of sheets in a given discharge stack thereof. The sensor, typically a small plastic molding, is pivoted upwardly by each discharged sheet and then pivots downwardly to rest upon the top side of the stack until this pivot cycle is initiated again by the next discharged sheet. Particularly when the discharged paper stack is relatively thick, the sensor is subject to being forced upwardly and broken by the stack as the stack is removed from the well by lifting it upwardly and rearwardly therefrom.

It can readily be seen from the foregoing that it would be desirable to provide an image reproduction machine of the general type described with paper discharge apparatus that eliminates or at least substantially reduces the above mentioned discharge problems, limitations and disadvantages. It is accordingly an object of the present invention to provide such apparatus.

SUMMARY OF THE INVENTION

In carrying out principles of the present invention, in accordance with a preferred embodiment thereof, an image reproduction machine generally as described in the preceding section is provided with specially designed paper deflector apparatus that uniquely functions to (1) essentially eliminate the aforementioned paper curling problem without causing appreciable crinkling of the image-imprinted sheets, (2) increase the maximum number of discharged sheets that may be operatively stacked within the housing well area, without altering the well geometry, and (3) protect the pivoted paper output sensor from damage or breakage by the paper stack as the stack is removed from the housing well area.

The image reproduction machine, representatively a laser printer, is provided with a horizontally spaced series of exit roller sets positioned at the printer housing outlet opening. Each exit roller set includes a relatively large diameter resilient drive roller laterally pressed against a smaller diameter along a paper nip area horizontally aligned with the nip areas of the other exit roller sets, along which a discharging paper sheet is frictionally gripped as the exit roller sets drive the sheet outwardly into the open-topped well area through the housing outlet opening.

The paper deflector apparatus, in a preferred embodiment thereof, is removably attachable to the printer above the exit roller sets and is provided with a plurality of first depending deflector means that are interdigitated with the exit roller sets. Each of these first depending deflector means has a bottom surface area centrally positioned between an adjacent pair of exit roller sets at a level somewhat lower than those of the roller set nip areas. As each successively discharged sheet is gripped by and driven through the exit roller sets, the bottom surface areas of the first depending deflector means contact and downwardly bend portions of the sheet disposed between adjacent pairs of the exit roller sets.

Such downward bending causes the discharging sheet to temporarily assume a corrugated configuration as it exits the roller sets. This serves to momentarily stiffen the sheet, as its leading edge forwardly approaches the rear edge of the horizontal bottom surface portion of the receiving well, and prevent its leading edge from striking the ramped well surface and causing the sheet to roll up in the rear well depression. Importantly, the first depending deflection means are configured, and positioned relative to the exit roller sets, in a manner such that the temporary sheet corrugations have a rather gentle curvature which, coupled with a relatively large sheet contact surface of each of the deflection means, serves to prevent both creasing and sideways crinkling of the discharging sheet.

The paper deflector apparatus is also provided with a spaced plurality of second depending deflector means having bottom surface portions positioned somewhat above the bottom surface portions of the first depending deflector means. As a rear top side edge section of the discharged paper stack portion within the depressed rear well area begins to upwardly approach housing outlet opening, the second depending deflector means function to downwardly engage each successively discharged sheet in a manner forcing a leading edge portion thereof against a rear edge portion of the previously discharged sheet on the top of the stack. The contact by the discharging sheet with the underlying sheet causes the underlying sheet (and one or more sheets beneath it) to be forwardly offset relative to the discharging sheet after it exits the housing outlet opening and comes to rest on top of the balance of the paper stack.

This frictional forward shifting effect is repeated by each successively discharged sheet, by the action thereon of the second depending deflector means, in a manner causing an uppermost portion of the stacked sheets to be progressively staggered in a forward direction relative to one another. This forward relative staggering of the uppermost stack sheets serves to diminish the stack depth adjacent the housing outlet opening relative to the stack depth over the horizontal bottom side surface of the housing well area.

The effect of such stack depth reduction adjacent the housing opening is to advantageously increase the total number of discharged sheets that may be operatively stacked in the well area before the sheets must be removed to clear an external discharge path for a new batch of sheets. In an illustrated embodiment of an image reproduction machine provided with the paper deflector apparatus of the present invention, the nominal 450 sheet discharge stacking capacity of the machine is increased to at least 500 sheets, thereby providing the machine with a convenient one ream paper feed batch capacity.

In a preferred embodiment thereof, the paper deflector apparatus is a molded plastic plate member having an elongated rectangular configuration having a longitudinally spaced plurality of clip portions formed on its bottom side surface and permitting the deflector plate to be removably clipped onto a support bar portion of the machine that overlies the housing outlet opening. The aforementioned first and second depending deflector means are formed on the clip portions.

According to another feature of the present invention, the leading side edge of the deflector plate has a small notch formed therein. The notch is positioned and configured to receive an outer end portion of the paper output sensor member as it is upwardly pivoted by contact with the paper stack as the stack is lifted upwardly and rearwardly out of the housing well area. The receipt of the outer end portion of the paper output sensor member in the deflector plate notch serves to limit the upward pivotal motion of the member, and limit the upward bending forces thereon, to thereby protect the member from damage or breakage by the paper stack as the stack is lifted from the well area.

DETAILED DESCRIPTION

Figure 1:
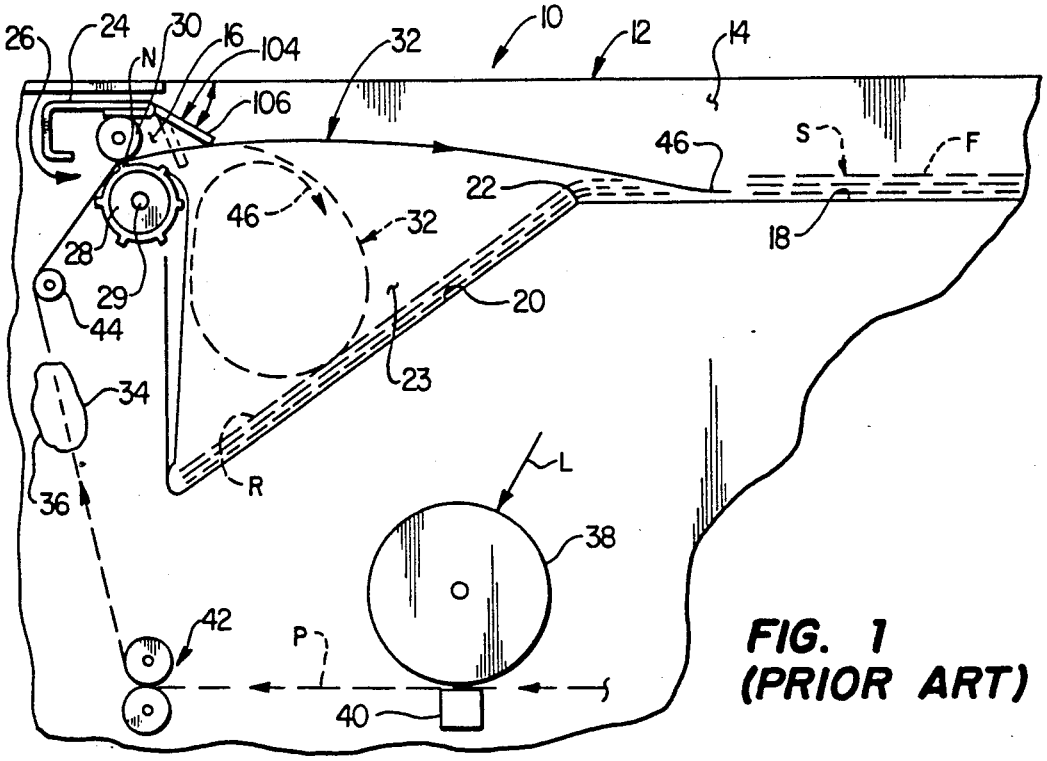
FIG. 1 (PRIOR ART)
FIG. 1 (Prior Art) is a schematic partial cross-sectional view through a conventional laser printer illustrating a portion of its paper feed path, and depicting a potential curling problem associated with an image-imprinted paper sheet being discharged from its housing outlet opening.

Cross-sectionally illustrated in simplified form in FIG. 1 (Prior Art) is a conventional image reproduction machine representatively in the form of a laser printer 10. Printer 10 has a housing 12 provided with an open-topped discharged paper receiving well area 14 positioned forwardly (i.e., rightwardly) of a horizontally elongated housing outlet opening 16. Well 14 has a horizontal bottom side surface 18 which is forwardly and downwardly offset from the outlet opening 16, and a downwardly and rearwardly ramped surface 20 extending rearwardly from the back edge 22 of surface 18 and forming the front boundary of a depressed rear end area 23 of the well.

Positioned immediately above the outlet opening 16 is an elongated metal support bar 24 that extends parallel to the outlet opening and overlies three horizontally spaced exit roller sets 26. Each exit roller set 26 includes a resilient drive roller 28 connected to a drive shaft 29, and a smaller diameter idler roller 30 pressed downwardly against the drive roller and rearwardly offset relative thereto.

The exit roller sets 26 form a portion of paper feed means that are operative to drive successive cut paper sheets, such as the illustrated sheet 32 through the housing 12, along a dotted line feed path P, and then forwardly discharge the sheets into the well area 14 in a manner such that they come to rest therein in a stack S. In the stack S, front portions F of the sheets rest upon the horizontal well surface 18, with rear portions R of the sheets being downwardly bent into the depressed well area **14*a* and supported on its ramped rear surface 20**.

The paper feed path P is bounded on opposite sides thereof by conventional guide structures, such as the schematically depicted structures 34 and 36, that serve to define the path. As each successive sheet is operatively fed through the housing 12 along path P, it sequentially passes between a rotating photoconductive drum 38 and a corotron unit 40, through a fuser unit 42, around a guide roller 44, and into the nip areas N between the contacting drive and idler roller pairs 28,30.

As each sheet passes between the drum 38 and the corotron unit 40, toner deposited on the drum in a predetermined image pattern controlled by a laser L beamed onto the drum, is electrically transferred onto the sheet by the corotron. The transferred toner is then fused onto the sheet, by a combination of heat and mechanical pressure, by the fuser unit 42 as the sheet is passed therethrough on its way to the nip areas N of the exit roller sets 26.

The printer 10 is conventionally designed and configured in a manner such that as each imprinted sheet 32 is forwardly discharged through the housing outlet opening 16, while the discharged sheet portion naturally bends downwardly due to its weight, the leading sheet edge portion 46 will upwardly and forwardly clear the back well surface edge 22 and then contact and slide forwardly along the horizontal well surface 18 (or the top side of stack S as the case may be) until the remainder of the sheet is discharged and falls downwardly into the depressed rear well area 23.

In this conventionally designed printer, a paper curling problem can arise—particularly when relatively light weight paper is being used—due to the relatively sharp paper exit bend at the fuser 42 that tends to "set" a curl in each sheet exiting the fuser. This curling tends to accentuate the downward bending of the sheet 32, as it exits the housing outlet opening 16, to an extent that its leading edge portion 46 strikes the ramped well surface 20 (or the downwardly bent rear stack portion as the case may be), thereby causing the sheet 32 to simply roll up in the depressed well area 23 as indicated in dotted lines in FIG. This occurrence, of course, prevents the desired orderly stack S from being formed, and greatly reduces the number of sheets that can be discharged from the housing 12 is a given printing batch.

Figure 2:
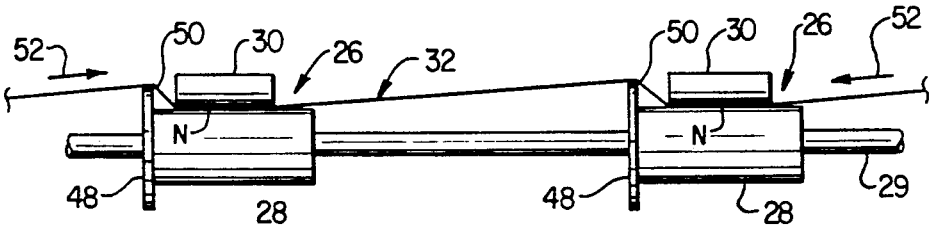
FIG. 2 (PRIOR ART)
FIG. 2 (Prior Art) is a schematic side elevational view of a pair of conventional printer exit roller sets provided with radially enlarged corrugating end portions in an attempt to solve this paper curling problem.

A conventional solution to this paper curling problem is shown in simplified form in FIG. 2 (Prior Art) and involves the placement of radially enlarged corrugating discs 48 on one end of each of the drive rollers 28 closely adjacent its associated nip area N. As the sheet 32 is forwardly discharged from the exit roller sets 26, the discs 48 form relatively sharp corrugating bends 50 in the sheet along its entire length. These sharp corrugating bends 50 tend to stiffen the discharging sheet to an extent counteracting the undesirable sheet curl sufficiently to cause the leading sheet edge portion to upwardly and forwardly clear the back well surface edge portion 22 as intended.

The paper stiffening achieved by the thin corrugating discs 48, however, tends to create two new paper handling problems. First, the sharp corrugating bends created closely adjacent the nip areas N tend to undesirably form small but permanent crease lines along the length of the sheet. Second, the positioning of the corrugating structures immediately adjacent the nip areas N tends to impose substantial lateral shortening forces on the sheet as it traverses the nip areas. These shortening forces can cause portions of the sheet to longitudinally slide along the nip areas, as indicated by the arrows 52 in FIG. 2, thereby permanently crinkling the discharging sheets.

Figure 3:
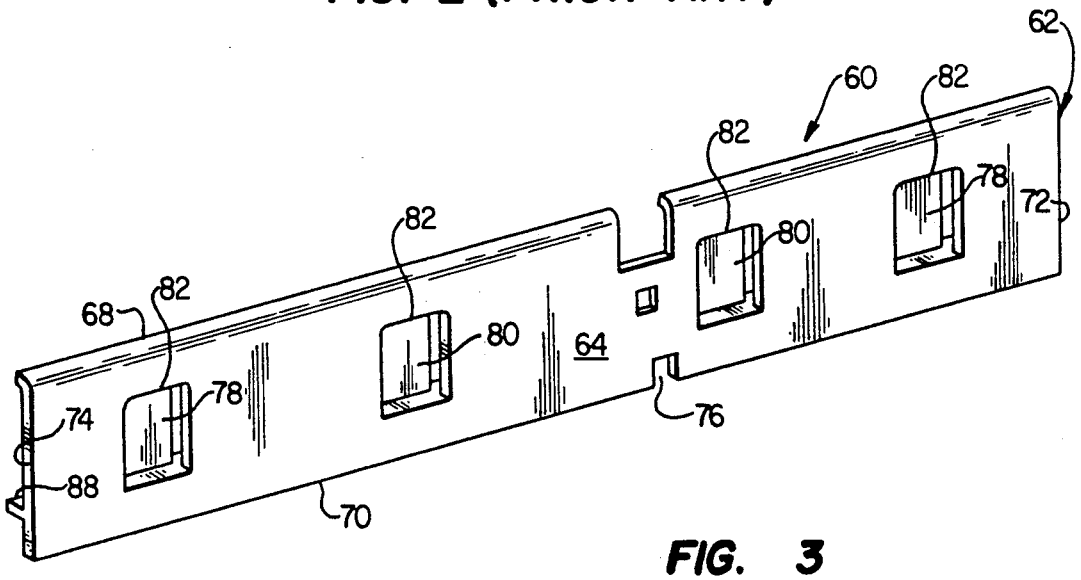
FIG. 3 is a top side perspective view of a paper discharge deflector plate structure embodying principles of the present invention.
Figure 4:
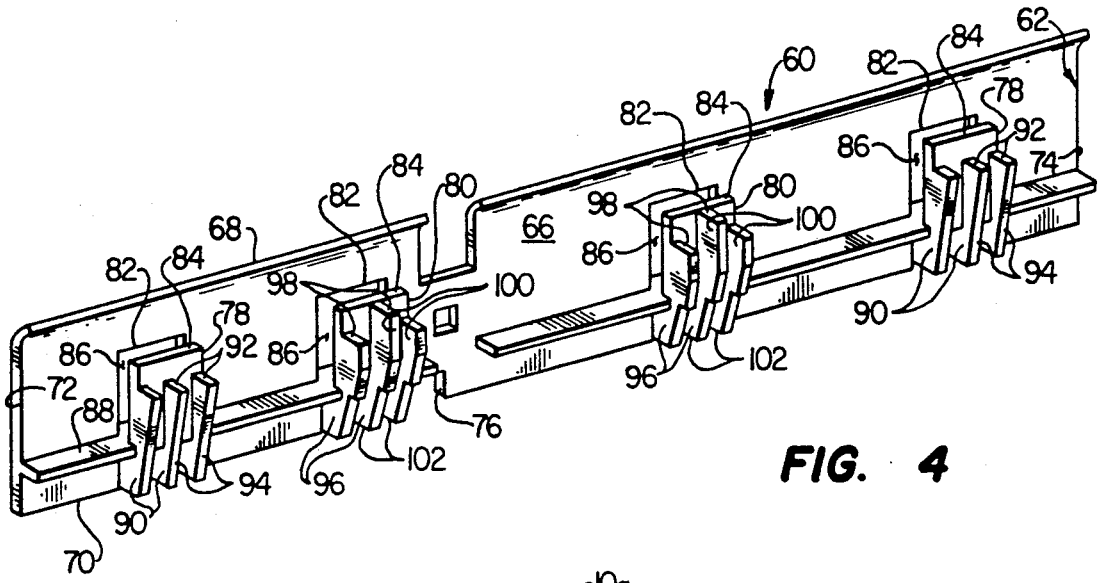
FIG. 4 is a bottom side perspective view of the deflector plate structure.

Turning now to FIGS. 3 and 4, these paper feed problems are uniquely solved by the provision and attachment to the laser printer 10 (or to another type of image reproduction machine having a similarly configured paper discharge portion) of exiting paper deflector apparatus that embodies principles of the present invention. In the illustrated preferred embodiment thereof, the apparatus is in the form of a molded plastic deflector bar 60 having an elongated rectangular base portion 62 with a length approximately equal to the horizontal length of the support bar 24 (FIG. 1).

Base portion 62 has a top side 64; a bottom side 66; a slightly downturned rear side edge 68; a front side edge 70; and a pair of opposite end edges 72 and 74. For purposes later described, a small rectangular notch 76 is formed in the front side edge 70. A longitudinally spaced series of two outboard clips 78 and two inboard clips 80 are formed on front edge portions of the underside of the base portion 62 beneath and downwardly offset from rectangular molding openings 82 therein. Each of the clips 78,80 extends rearwardly from its connection to the base portion 62, has a free rear end 84, and defines with the underside of the base portion 62 a rearwardly opening slot 86 that is forwardly bounded by a longitudinally extending transverse rib 88 projecting outwardly from the bottom side 66 of the base portion 62.

As can best be seen in FIG. 4, depending from the underside of each of the two outboard clips 78 are three spaced apart ribs 90 having rear end surfaces 92 forwardly offset from the rear ends 84 of clips 78, and aligned, forwardly and downwardly sloping bottom side edge surface 94. Depending from the underside of each of the inboard clips 80 are three spaced ribs 96 having rear end surfaces 98, the central surface 98 being aligned with the clip end 84, with the two outboard surfaces 98 in each three rib set being forwardly offset from their associated clip end 84.

For purposes later described, rear portions 100 of the bottom side edge surfaces of ribs 96 are parallel to the bottom side surface 66 of base portion 62 and are deeper in a downward direction than the ribs 90 on the outboard clips 78. Front end portions 102 of the bottom side edges of the ribs 96 are aligned with and sloped identically to front end portions of the bottom side edge surfaces of the ribs 90 on the outboard clips 78.

Figure 5:
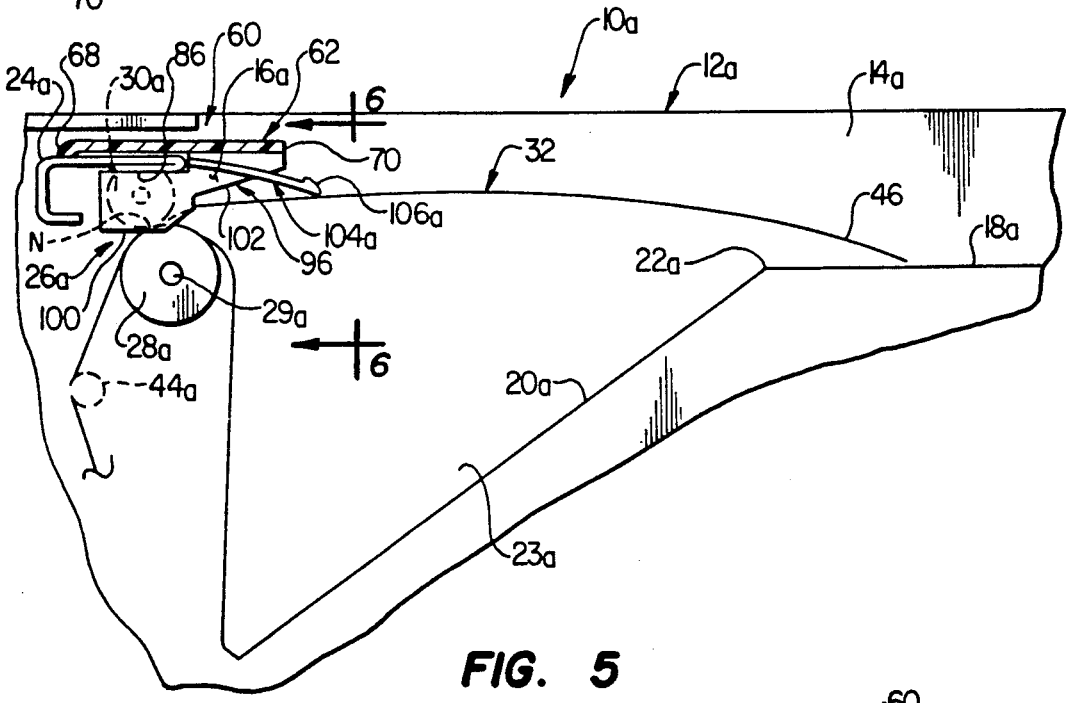
FIG. 5 is an enlarged scale cross-sectional view through the printer illustrating the deflector plate structure operatively attached thereto and functioning to nonpermanently corrugate and temporarily stiffen a paper sheet being discharged from the printer housing outlet opening.

Turning now to FIG. 5, portions of an improved laser printer 10*a* are cross-sectionally illustrated in somewhat schematic form. Printer 10*a* is identical to the conventional printer 10 previously described in conjunction with FIG. 1 except for the addition thereto, in a manner subsequently described, of the specially designed paper deflector bar 60 of the present invention. For ease in comparison between the improved printer 10*a* and the conventional printer 10, components in printer 10*a* similar to those in printer 10 have been given identical reference numerals with the subscripts "*a*".

The deflector bar 60 is removably installed on the support bar 24*a* simply by inserting the leading front edge of the support bar 24*a* into the clip slots 86 (see FIG. 4) and then pushing the deflector bar rearwardly onto the support bar until the leading edge of the support bar bottoms out against the elongated bottom side rib 88 of the base portion 62 of the deflector bar. The downturned rear side edge 68 of the base portion 62 serves to frictionally retain the deflector bar 60 in place on the support bar 24*a*.

Figure 6:
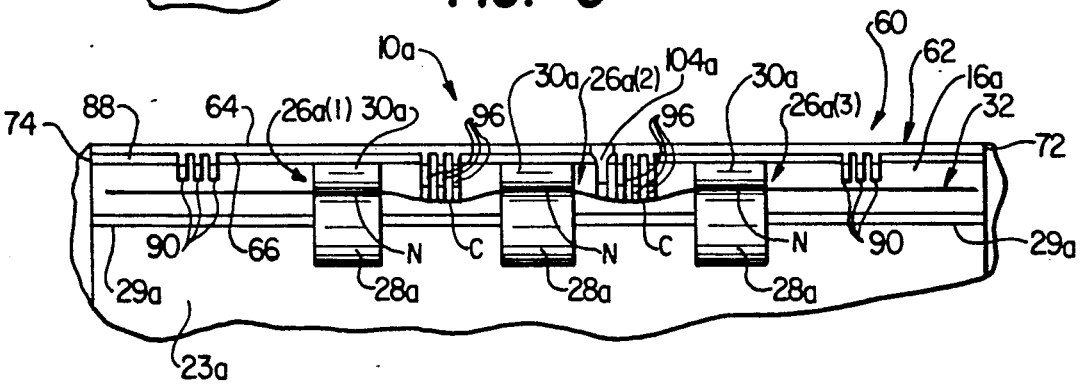
FIG. 6 is a cross-sectional view through the discharging sheet, taken along line 6—6 of FIG. 5, schematically illustrating the unique paper corrugating and stiffening action of the deflector plate structure.

As best illustrated in FIG. 6, with the deflector bar 60 removably installed in this manner, the two sets of outboard ribs 90 are spaced outwardly apart from the horizontally outer exit roller sets 26*a*(1) and 26*a*(3) and are spaced slightly upwardly apart from the nip areas N. Each of the two sets of inboard ribs 96 are centrally positioned between one of the two adjacent exit roller set pairs 26*a*(1),26*a*(2) and 26*a*(2),26*a*(3), with the deepened rear portions 100 of ribs 96 (see FIG. 5) being somewhat downwardly offset relative to the nip areas N.

As the sheet 32 is forwardly discharged outwardly through the housing outlet opening 16*a*, the deepened rear portions 100 of the depending deflector ribs 96 downwardly contact and bend lateral portions of the sheet centrally disposed between the adjacent exit roller set pairs 26*a*(1),26*a*(2) and 26*a*(2),26*a*(3) to form corrugation areas C in the discharging sheet. These corrugation areas C in the sheet 32 serve to stiffen the sheet as it passes over the depressed housing well area 23*a*, thereby permitting the leading sheet edge portion 46 to upwardly and forwardly clear the rear well surface edge portion 22*a* to cause sheet 32, and subsequently imprinted and discharged sheets to stack properly in the well area 14*a*.

Importantly, due to their central positioning between adjacent pairs of exit roller sets, and their relatively wide undersurface areas that contact the sheet 32, the deepened rear portions 100 of the inboard rib sets 96 cause the corrugation areas C to assume a rather gentle downward curvature and to progressively dissipate as the sheet is discharged. Because of these temporary sheet corrugation and stiffening characteristics provided by the ribs 96, the sheet 32 is not permanently creased, and does not have a tendency to laterally crinkle, as it passes through the exit roller sets 26*a*. It can readily be seen that this provides a substantial improvement over the conventional sheet corrugating and stiffening structure shown in FIG. 2.

Figure 7:
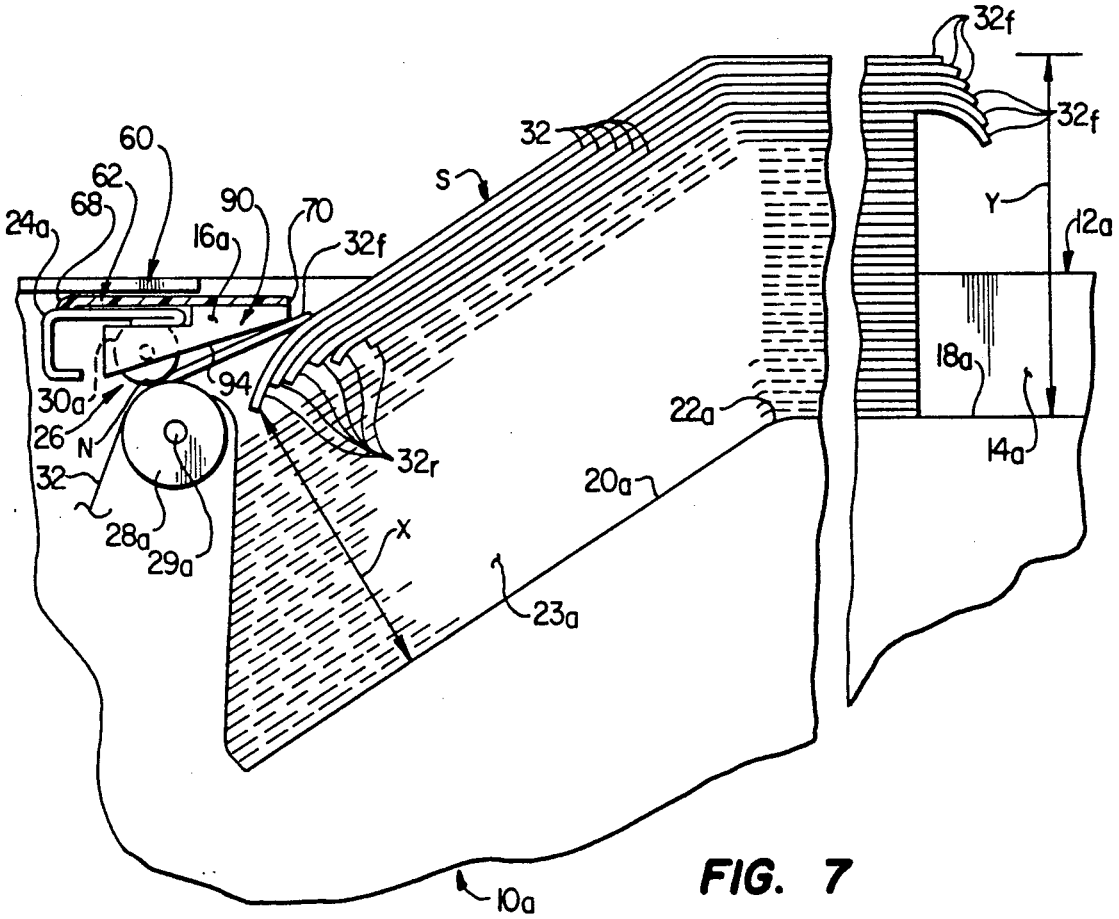
FIG. 7 is a horizontally foreshortened cross-sectional view through the printer, similar to that shown in FIG. 5, schematically illustrating a paper stack height increasing feature of the deflector plate structure.

Referring now to FIGS. 1 and 7, the installed deflector bar 60 provides the improved laser printer 10*a* with another desirable feature, provided by front underside portions of the depending deflector ribs 90 and 96, namely the ability to operatively stack a substantially larger number of sheets 32 in the housing well area 14*a*, during a given printout batch, than can be accommodated in the identically configured well area 14 of the conventional printer 10 shown in FIG. 1.

As a rear top side portion of a discharged paper sheet stack S upwardly approaches the housing outlet opening 16 in the conventional printer 10, rear edge portions of the uppermost sheets in the stack will begin to block the external paper discharge path of the printer, thereby requiring the printing to be stopped until the stack is removed from the well area. Typically, in the illustrated conventional printer 10, this event occurs when about 450 or so discharged sheets (i.e., a number of sheets substantially less then the 500 sheets in a standard one rear package) have been stacked in the housing well area.

In the representative improved printer 10*a*, however, 500 or more discharged sheets 32 may be operatively stacked in the well area 14*a* at one time as will now be described with reference to FIG. 7. As the number of discharged sheets 32 in stack S increases, the top side of a rear portion of the stack begins to upwardly approach the housing outlet opening 16*a*. When this occurs, the front edge portion 32*f* of the discharging sheet 32 is downwardly contacted by front undersurface portions of the depending deflector ribs 90,96 (which are upwardly offset relative to the exit roller nip areas N) in a manner forcing such front edge portion 32 into frictional forward sliding contact with the underlying rear edge portion 32*r* of the previously discharged sheet 32.

Such frictional sliding contact causes the front edge portion 32*f* of each underlying sheet 32 in an uppermost stack portion to be forwardly staggered relative to the front edge portion 32*f* of the next discharged sheet, and also causes a similar front-to-rear staggering of the rear edge portions 32*r* of the two sheets. This progressive staggering of the rear end portions 32*r* in an uppermost section of the stack S uniquely functions to reduce the effective stack height X adjacent the outlet opening 16*a* in the depressed well area 23*a* compared to the actual stack height Y above the horizontal bottom well side surface 18*a*.

In turn, this permits a substantially larger of sheets 32 to be operatively stacked in well 14*a* than could be operatively stacked in the identically configured well 14 of the conventional printer 10. For example, in the illustrated conventional printer 10, the maximum stack capacity is approximately 450 sheets. With the paper deflector bar 60 installed, however, it is able to operatively stack at least 500 sheets—i.e., a full one ream package of cut paper sheets.

Referring now to FIGS. 1 and 5, the printers 10 and 10*a* are respectively provided with conventional paper output sensor members 104,104*a* that are pivoted upwardly and downwardly by the successively discharged sheets 32 as they upwardly contact the sensor member outer end portions 106,106*a*. In the printer 10, the sensor member 104 is susceptible to being upwardly pivoted and broken off by the paper stack S as the stack is upwardly and rearwardly lifted out of the housing well 14. However, this potential sensor member breakage is essentially eliminated in the improved printer 10*a*.

Figure 8:
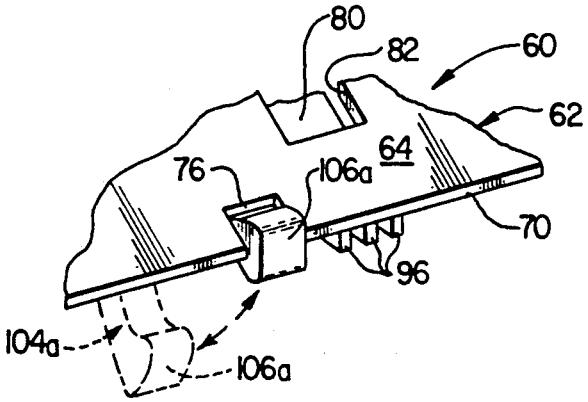
FIG. 8 is an enlarged scale perspective view of a portion of the deflector plate structure illustrating the manner in which it protects the printer's pivotable paper output sensor member against damage or breakage as a discharged paper stack is lifted out of the paper receiving well area of the printer.

Specifically, as shown in FIG. 8, as the sensor member 104*a* is upwardly engaged and pivoted by the paper stack S during upward and rearward removal of the stack from the well area 14*a*, the outer sensor member end portion 106*a* is upwardly received and retained in the front edge notch 76 of the base portion 62 of the deflector bar 60. This safely limits the upper pivotal motion of the member 104*a* and prevents excessive counterclockwise torque from being imposed thereon by the paper stack as it is being lifter out of the housing well area 14*a*.

The foregoing detailed description is to be clearly understood as being given by way of illustration and example only, the spirit and scope of the present invention being limited solely by the appended claims.

What is claimed is:

1. An image reproduction machine comprising:

a housing having a horizontally elongated outlet opening, and a well area for receiving and stacking therein cut paper sheets successively discharged in a forward direction from said outlet opening;

feed means for successively feeding cut paper sheets through said housing and then discharging the sheets outwardly through said outlet opening into said well area, said feed means including a horizontally spaced series of rotationally drivable exit roller sets each positioned adjacent said outlet opening and including a duality of rollers bearing against one another along a nip area;

means for reproducing a predetermined image on the sheets as they are fed through said housing; and paper deflector apparatus including a plurality of deflector means transversely extending generally centrally between adjacent pairs of said exit roller sets to a level vertically past said nip area, said deflector means being operative to contact and bend spaced portions of each discharging sheet being forwardly passed through said nip area in a manner temporarily corrugating and stiffening the discharging sheet without permanently creasing or crinkling it, said image reproduction machine having an elongated, plate-like support member positioned above said exit roller sets and generally parallel to their axes, said paper deflector apparatus including an elongated, plate-like base portion having a plurality of clip means for releasably attaching said base portion to and in a longitudinally parallel relationship with said support member, and said plurality of deflector means projecting downwardly beyond an underside of said base portion and are longitudinally spaced along and transverse to the length of said base portion.

2. The image reproduction machine of claim 1 wherein:

said plurality of deflector means depend from said plurality of clip means.

3. The image reproduction machine of claim 2 wherein:

each of said plurality of deflector means include a plurality of ribs depending from one of said plurality of clip means and being spaced apart from one another in a direction parallel to the length of said base portion.

4. The image reproduction machine of claim 3 wherein:

said base portion has a front side edge, and each of said ribs has a bottom side edge surface having a downwardly and rearwardly sloped front portion, and a rear portion parallel to the underside of said base portion and downwardly offset relative to said front portion.

5. The image reproduction machine of claim 4 wherein:

said image reproduction machine has an elongated paper output sensor member supported at an inner end for vertical pivotal movement forwardly of said exit roller sets, said sensor member having an outer end portion, and said front side edge of said base portion has a notch formed therein, said notch being positioned and configured to upwardly and releasably receive said outer end portion of said sensor member in a manner limiting the upward pivotal movement of said sensor member.

6. The image reproduction machine of claim 5 wherein:

said deflector apparatus is a one piece plastic molding.

7. An image reproduction machine comprising:

a housing having a horizontally elongated outlet opening, and a well area for receiving and stacking therein cut paper sheets successively discharged in a forward direction from said outlet opening, said well area having:

a front section having a horizontal bottom side surface for supporting front portions of the discharged sheets, said horizontal bottom side surface being downwardly and forwardly offset relative to said outlet opening and being rearwardly bounded by a back edge portion, and a depressed rear section having a ramped bottom side surface for supporting downwardly bent rear portions of the discharged sheets, said ramped bottom side surface sloping downwardly and rearwardly from said back edge portion of said horizontal bottom side surface;

feed means for successively feeding cut paper sheets through said housing and then discharging the sheets outwardly through said outlet opening into said well area, said feed means including a horizontally spaced series of rotationally drivable exit roller sets each positioned adjacent said outlet opening and including a duality of rollers bearing against one another along a nip area;

means for reproducing a predetermined image on the sheets as they are fed through said housing; and paper deflector apparatus including a plurality of deflector means positioned above said exit roller sets and spaced apart from one another in a direction parallel to the axes of said exit roller sets, said plurality of deflector means extending downwardly toward said exit roller sets to a level above said nip areas and being operative, as a rear end edge portion of a paper stack being formed in said well area upwardly approaches said outlet opening, to:

downwardly contact each subsequently discharging sheet in a manner causing a front end portion thereof to frictionally and slidably contact a rear end portion of the previously discharged sheet, and create in an uppermost number of the stacked sheets a relative forward staggering between each underlying sheet and its immediately overlying sheet in a manner decreasing the effective stack height adjacent said outlet opening relative to the stack height above said horizontal bottom side surface of said well area and thereby increase the maximum number of discharged sheets that may be operatively stacked in said well area before the stack must be removed therefrom.

8. The image reproduction machine of claim 7 wherein said image reproduction machine is a laser printer.

9. The image reproduction machine of claim 7 wherein:

said image reproduction machine has an elongated, plate-like support member positioned above said exit roller sets and generally parallel to their axes, said paper deflector apparatus includes an elongated, plate-like base portion having a plurality of clip means for releasably attaching said base portion to said support member, and said plurality of deflector means project downwardly beyond and are longitudinally spaced along and transverse to the length of said base portion.

10. The image reproduction machine of claim 9 wherein:

said plurality of deflector means depend from said plurality of clip means.

11. The image reproduction machine of claim 10 wherein:

each of said plurality of deflector means include a plurality of ribs depending from one of said plurality of clip means and being spaced apart from one another in a direction parallel to the length of said base portion.

12. The image reproduction machine of claim 11 wherein:

said base portion has a front side edge, and each of said ribs has a downwardly and rearwardly sloped bottom side edge surface portion positioned to downwardly engage each of said uppermost number of sheets as they are forwardly discharged through said outlet opening.

13. The image reproduction machine of claim 12 wherein:

said image reproduction machine has an elongated paper output sensor member supported at an inner end for vertical pivotal moment forwardly of said exit roller sets, said sensor member having an outer end portion, and said front side edge of said base portion has a notch formed therein, said notch being positioned and configured to upwardly and releasably receive said outer end portion of said sensor member in a manner limiting the upward pivotal movement of said sensor member.

14. The image reproduction machine of claim 13 wherein said paper deflector apparatus is a one piece plastic molding.

15. An image reproduction machine comprising:

a housing having a horizontally elongated outlet opening, and a well area for receiving and stacking therein cut paper sheets successively discharged in a forward direction from said outlet opening, said well area having:

a front section having a horizontal bottom side surface for supporting front portions of the discharged sheets, said horizontal bottom side surface being downwardly and forwardly offset relative to said outlet opening and being rearwardly bounded by a back edge portion, and a depressed rear section having a ramped bottom side surface for supporting downwardly bent rear portions of the discharged sheets, said ramped bottom side surface sloping downwardly and rearwardly from said back edge portion of said horizontal bottom side surface;

feed means for successively feeding cut paper sheets through said housing and then discharging the sheets outwardly through said outlet opening into said well area, said feed means including a horizontally spaced series of rotationally drivable exit roller sets each positioned adjacent said outlet opening and including a duality of rollers bearing against one another along a nip area;

means for reproducing a predetermined image on the sheets as they are fed through said housing; and paper deflector apparatus including:

a spaced plurality of first deflector means downwardly extending generally centrally between adjacent pairs of said exit roller sets to a level below that of said nip area, said spaced plurality of first deflector means being operative to contact and downwardly bend spaced portions of each discharging sheet being forwardly passed through said nip area in a manner temporarily corrugating and stiffening the discharging sheet without permanently creasing or crinkling it, and a spaced plurality of second deflector means positioned above said exit roller sets and spaced apart from one another in a direction parallel to the axes of said exit roller sets, said plurality of second deflector means extending downwardly toward said exit roller sets to a level above said nip area and being operative, as a rear end edge portion of a paper stack being formed in said well area upwardly approaches said outlet opening, to:

(1) downwardly contact each subsequently discharging sheet in a manner causing a front end portion thereof to frictionally and slidably contact a rear end portion of the previously discharged sheet, and (2) create in an uppermost number of the stacked sheets a relative forward staggering between each underlying sheet and its immediately overlying sheet in a manner decreasing the effective stack height adjacent said outlet opening relative to the stack height above said horizontal bottom side surface of said well area and thereby increase the maximum number of discharged sheets that may be operatively stacked in said well area before the stack must be removed therefrom.

16. The image reproduction machine of claim 15 wherein said image reproduction machine is a laser printer.

17. The image reproduction machine of claim 15 wherein:

said image reproduction machine has an elongated, plate-like support member positioned above said exit roller sets and generally parallel to their axes, said paper deflector apparatus includes an elongated, plate-like base portion having a longitudinally spaced plurality of clip means for releasably attaching said base portion to said support member, and said spaced pluralities of first and second deflector means project downwardly beyond an underside of said base portion and are longitudinally spaced along and transverse to the length of said base portion.

18. The image reproduction machine of claim 17 wherein:

said spaced pluralities of first and second deflector means depend from said longitudinally spaced pluralities of clip means.

19. The image reproduction machine of claim 18 wherein:

each of said spaced pluralities of first and second deflector means include a plurality of ribs depending from one of said longitudinally spaced plurality of clip means and being spaced apart from one another in a direction parallel to the length of said base portion.

20. The image reproduction machine of claim 19 wherein:

said image reproduction machine has an elongated paper output sensor member supported at an inner end for vertical pivotal movement forwardly of said exit roller sets, said sensor member having an outer end portion, and a front side edge of said base portion having a notch formed therein, said notch being positioned and configured to upwardly and releasably receive said outer end portion of said sensor member in a manner limiting the upward pivotal movement of said sensor member.

21. The image reproduction machine of claim 20 wherein said paper deflector apparatus is a one piece plastic molding.

* * * * *

UNITED STATES PATENT AND TRADEMARK OFFICE

CERTIFICATE OF CORRECTION

PATENT NO. : 5,194,904
DATED : March 16, 1993
INVENTOR(S) : Mark H. Ruch

It is certified that error appears in the above-identified patent and that said Letters Patent is hereby corrected as shown below:

Column 11, line 51, delete "areas" and insert --area--.

Signed and Sealed this

First Day of February, 1994

Bruce Lehman

*Attest:*

BRUCE LEHMAN

*Attesting Officer*

*Commissioner of Patents and Trademarks*